US007862974B2

(12) United States Patent
Sugama et al.

(10) Patent No.: US 7,862,974 B2
(45) Date of Patent: Jan. 4, 2011

(54) TONER FOR ELECTROPHOTOGRAPHY

(75) Inventors: Kouji Sugama, Hachioji (JP); Masafumi Uchida, Toyokawa (JP); Kenji Yamane, Sagamihara (JP); Kenji Hayashi, Hachioji (JP); Ryuji Kitani, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/578,317

(22) Filed: Oct. 13, 2009

(65) Prior Publication Data

US 2010/0062362 A1 Mar. 11, 2010

Related U.S. Application Data

(62) Division of application No. 11/036,073, filed on Jan. 18, 2005, now abandoned.

(30) Foreign Application Priority Data

Jan. 21, 2004 (JP) ..... 2004-012848

(51) Int. Cl.
*G03G 5/00* (2006.01)
*G03G 9/00* (2006.01)

(52) U.S. Cl. ..... 430/110.2; 430/110.3; 430/110.4

(58) Field of Classification Search ..... 430/110.2, 430/110.3, 110.4
See application file for complete search history.

(56) References Cited

U.S. PATENT DOCUMENTS

| | | | | |
|---|---|---|---|---|
| 4,837,107 | A * | 6/1989 | Axelsson et al. | 430/137.11 |
| 4,980,257 | A | 12/1990 | Anno et al. | |
| 5,215,854 | A | 6/1993 | Yamazaki et al. | |
| 5,849,456 | A | 12/1998 | Matsumura et al. | |
| 5,952,144 | A | 9/1999 | Hesegawa et al. | |
| 6,200,718 | B1 | 3/2001 | Takasaki et al. | |
| 6,617,091 | B2 | 9/2003 | Nishimori et al. | |
| 6,703,177 | B2 | 3/2004 | Yamazaki et al. | |
| 7,517,631 | B2 * | 4/2009 | Ota | 430/137.11 |
| 2002/0039699 | A1 | 4/2002 | Nishimori et al. | |
| 2002/0127036 | A1 | 9/2002 | Sato et al. | |
| 2003/0027072 | A1 | 2/2003 | Horiuchi et al. | |
| 2003/0215732 | A1 * | 11/2003 | Uchida et al. | 430/110.3 |
| 2003/0219666 | A1 | 11/2003 | Kitani et al. | |
| 2003/0219669 | A1 | 11/2003 | Yamashita et al. | |
| 2004/0229147 | A1 | 11/2004 | Higuchi et al. | |
| 2005/0074685 | A1 | 4/2005 | Kido et al. | |

FOREIGN PATENT DOCUMENTS

| | | | |
|---|---|---|---|
| JP | 61-166553 | A | 7/1986 |
| JP | 62-075541 | A | 4/1987 |
| JP | 02-000880 | A | 1/1990 |
| JP | 02-259657 | A | 10/1990 |
| JP | 03-126041 | A | 5/1991 |
| JP | 03-228066 | A | 10/1991 |
| JP | 9-43896 | | 2/1997 |
| JP | 10-26842 | | 1/1998 |
| JP | 10-123748 | A | 5/1998 |
| JP | 2000-10377 | | 1/2000 |
| JP | 2000-147829 | A | 5/2000 |
| JP | 2000-292978 | A | 10/2000 |
| JP | 2002-116574 | | 4/2002 |
| JP | 2002-148866 | | 5/2002 |
| JP | 2002-207312 | A | 7/2002 |
| JP | 2002-328485 | A | 11/2002 |
| JP | 2002-351142 | | 12/2002 |
| JP | 2003-058011 | A | 2/2003 |
| JP | 2003-076055 | A | 3/2003 |
| JP | 2003-215836 | A | 7/2003 |

OTHER PUBLICATIONS

Written Amendment and Argument filed Mar. 21, 2008, in Japanese Patent Application No. 2005-6415.
Decision of Refusal dated Apr. 10, 2008, issued in Japanese Patent Application No. 2005-6415.

* cited by examiner

*Primary Examiner*—Thorl Chea
(74) *Attorney, Agent, or Firm*—Finnegan, Henderson, Farabow, Garrett & Dunner, L.L.P.

(57) ABSTRACT

An embodiment may be an electrophotographic toner which comprises at least one toner particle which comprises an inner layer and an outer layer covering the inner layer, wherein a cross-sectional area ratio of the outer layer to the inner layer is 0.05-0.46, and wherein a non-uniform thickness exists in the outer layer, and further the average thickness (t) taken at 5 positions as calculated by, is about 0.2—about 1.0 μm, $t=(t_1+t_2+t_3+t_4+t_5)/5$ (unit of $t_1$-$t_5$ is μm)
wherein $t_1$ represents a thickness of the thickest part of the outer layer, and $t_2$-$t_5$ each represent a thickness of a second to a fifth thickest part of the outer layer in one particle, and wherein a glass transition point Tg of the inner layer is about 2—about 45° C. lower than Tg of the outer layer.

17 Claims, 1 Drawing Sheet

TONER FOR ELECTROPHOTOGRAPHY

CROSS-REFERENCE TO RELATED APPLICATIONS

This application is a divisional of U.S. application Ser. No. 11/036,073, filed Jan. 18, 2005 now abandoned, and claims priority to JP2004-012848, filed Jan. 21, 2004.

BACKGROUND

1. Field of the Invention

The present invention relates to a toner having toner particles, each of which is composed of an inner layer and an outer layer on its outer periphery.

2. Related Art

Initially, image forming devices based on electrophotographic systems were used and spread in the form of office copiers and printers. Currently, a wide product line, ranging from down-sized color printers for personal use to large-scaled ones, called "electrophotographic printers", has been developed, and its development competition has been increasingly vigorous.

Naturally, toners which are consumables of such devices are changing. Pulverization method toners which are the main stream in the early days have been replaced with chemical toners and polymerization method toners of a uniform particle size distribution and at a smaller particle size. Further, development of these chemical toners and polymerization method toners is not limited to the particle size and its distribution, and has made it possible to design new types of particles by modifying the particle surface. For example, such a toner, described below, is disclosed (refer, for example, to Patent Document 1). Surface-modified toner particles are produced in such a manner that a resinous layer is formed by fusing resinous particles onto toner particles (host body) containing colorants in a resinous phase. Whereby, the existing ratio of colorants which are exposed onto the surface of the toner particle decreases, and thus it is possible to form stable toner images which result in minimal variation of image density, background staining, and color tint during image formation over an extended period at an ambience of relatively high humidity. Further disclosed is the toner below (refer, for example, to Patent Document 2). Particles are formed upon controlling the dispersion state and occupied state of components incorporated in a toner so that effects due to ambient factors such as temperature or humidity are minimized. Subsequently, it is possible to consistently form high quality toner images. Alternatively disclosed is the toner below (refer, for example, to Patent Document 3). Minute particles are added to coagulated particles which are formed by coagulating resinous particles in a resinous particle dispersion so that the minute particles are adhered onto the surface of the coagulated particles. Further, toner particles are prepared by thermally fusing minute particles. Subsequently, it is possible to prepare a toner which exhibit-stable toner properties during the electrophotographic process in which various mechanical stresses are applied onto the surface of the toner particles. Specifically, toner particles in which the surface is covered with particles of desired retention properties have been proposed since early times. However, a number of problems associated with durability, cleaning properties and fixability still remain.

Recently, however, these problems have been overcome and the stage of practical use has started. Recently, waste paper post-processing devices are becoming more widespread, and processing such as double-sided printing, bookbinding, saddle stitch bookbinding, and Z-folding are automatically conducted at a high rate. Subsequently, demanded is a toner capable of meeting the demands of the foregoing.

Images composed of toner, which is designed to be fixable at a relatively low temperature, generally remain adhesive until the temperature drops to at most 50° C., whereby in the post-processing device, adhesion and irregular stacking of sheets of paper occur. On the other hand, when a larger amount of particles of high retention properties are employed onto the surface of toner particles, fixability at low temperatures is degraded. At the same time, problems occur in which color images particularly suffer from uneven glossiness. Problems associated with image adhesion and irregular stacking, and low temperature fixability are phenomena which are not compatible with each other, and therefore, it has been assumed that it is too difficult to make them compatible with each other. Furthermore, in order to correspond to belt (film) fixing as well as IH fixing which is receiving attention as a recent energy saving fixing, method demanded is fixability at a relatively low pressure, as well as an increase in the fixable temperature range which does not result in off-setting even though non-uniformity of temperatures occurs to fixing members.

(Patent Document 1)

Japanese Patent Publication Open to Public Inspection (hereinafter referred to as JP-A) No. 2002-116574 (paragraph 0005, etc.)

(Patent Document 2)

JP-A No. 2002-351142 (paragraph 0016, etc.)

(Patent Document 3)

JP-A No. 10-26842 (paragraph 0012, etc.)

SUMMARY

An embodiment of the present invention is a toner comprising at least one toner particle which comprises an inner layer and an outer layer covering the inner layer, wherein a cross-sectional area ratio of the outer layer to the inner layer is about 0.05—about 0.46, and wherein a non-uniform thickness exists in the outer layer, and further the average thickness (t) taken at 5 positions as calculated by, is about 0.2—about 1.0 μm, $t=(t_1+t_2+t_3+t_4+t_5)/5$ (unit of $t_1$-$t_5$ is μm)

wherein $t_1$ represents a thickness of the thickest part of the outer layer, and $t_2$-$t_5$ each represent a thickness of a second to a fifth thickest part of the outer layer in one particle, and wherein a glass transition point Tg of the inner layer is about 2—about 45° C. lower than a glass transition point Tg of the outer layer.

DETAILED DESCRIPTION OF THE EXEMPLARY EMBODIMENTS

Figure 1:
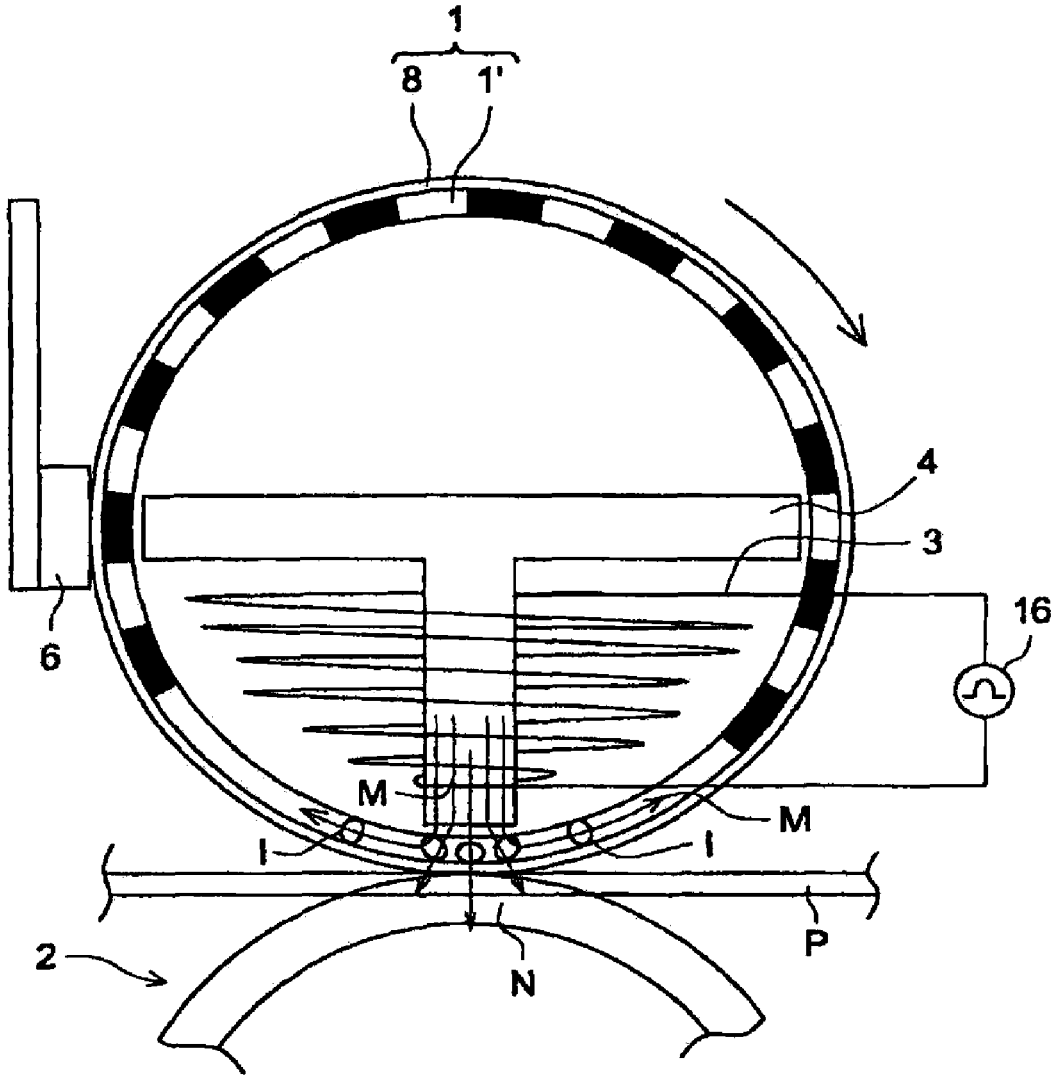
FIG. 1 is a schematic view of an example of a fixing roller explaining an eddy current heating system in the fixing roller.

In the course of investigation, the inventors of the present invention again recognized that in terms of viscoelasticity, it was extremely difficult to discover a toner which provided desired fixability at relatively low fixing temperatures as well as non-fusion of toner particles among them even though subjected to heat. Namely, in order to result in the desired fixability at relatively low temperatures, it is necessary to set the glass transition point of toner particles at relatively low temperatures so that the toner particles are softened. However, when the glass transition point decreases, toner particles tend to adhere to each other due to a decrease in viscoelasticity. On the contrary, as fusing temperature of toner particles at a relatively high glass transition point increases, it becomes difficult to achieve fixing at low temperatures.

In order to provide such incompatible functions in one toner particle, the inventors of the present invention assumed that when toner particles were produced in such a manner that regions which exhibited each function was separated, it became possible to obtain toner particles capable of being fixed at low temperatures as well as capable of holding a stable state so that except for the fixing process, toner particles did not fuse to each other. Further, a toner, which exhibited superior performance, was discovered in such a manner that in the production process of toner particles, after forming a toner inner layer which became a host particle of low viscoelasticity, resinous particles of higher viscoelasticity were fused onto the above host particle to form an outer layer and the 5-position average thickness of the outer layer became controllable.

Further, it was confirmed that the toner of the present invention extended the working life of heating members for fixing more than the case in which images were formed employing conventional toners, and such a tendency was markedly exhibited when images were formed in an ambience of low temperature and low humidity. The reasons why the toner of the present invention exhibits such effects are not clearly understood. It is roughly assumed that assured fusion is performed during the fixing process whereby non-fused toner particles are generated. Namely, it is assumed that when fixing is performed at low temperatures employing conventional toners, during the fixing process, non-fused toner particles are generated and the resulting toner particles in a charged state adhere onto heating members for fixing to shorten their working life.

One of the features of the present toner particles is that contrary to the fact that in conventional techniques, a uniform covering layer is provided about the inner layer, an outer layer which is subjected to intentionally and appropriately formed non-uniform thickness, is arranged as an outer layer. The region of the larger thickness retards thermal coagulation with the adjacent toner particles to result in additional storage stability. Due to the above addition, it becomes possible to approach the glass transition point of the outer layer to that of the inner layer, whereby the melt viscosity of the entire toner particles decreases and it is possible to enhance low temperature fixability of the toner.

When the melt viscosity of the entire toner particles or the inner layer portion decreases, heretofore, thermal deformation becomes excessive during pressure fixing, resolution has been degraded due to blocking of fine lines and fine text characters. However, in the present invention, it is assumed that since the elastic modulus of the outer layer is favorable, excellent resolution is exhibited as a low temperature fixing toner due to some contraction of fine lines after fixing.

When the difference in the glass transition point between the inner layer and the outer layers is in the range of the present invention, the inner layer and the outer layer are compatible due to heating during fixing, which can minimize generation of non-uniform glossiness. Further, it is preferable to incorporate releasing agents in the inner layer as well as in the outer layer, because glossiness becomes more uniform.

Even though the mechanism of the above is not clearly understood, it is assumed that thick portions of the outer layer gather in the surface layer of toner images to form convex portions. As a result, the number of contact points with the adjacent toner image decreases, whereby the resulting coefficient friction decreases. It is also assumed that in the same manner, the convex portions of a high glass transition point come into contact with the adjacent toner image, whereby anti-tacking effects are generated.

In belt fixing as well as film fixing, the heat capacity of heating members is generally small and their thermal conductivity is not sufficient. Further, including IH fixing, those exhibit poor controllability of temperature. Consequently, when the predetermined fixing temperature is lowered, fixing strength is degraded compared to conventional heat roller fixing, or on the contrary, off-setting results. However, with regard to the toner of the present invention, the fixable temperature range is broadened and is suitable for the belt fixing, as well as the IH fixing.

Specifically, a fixing system, which exhibits the desired effects of the present toner, is an eddy current heating system (a heating member generates heat, utilizing electromagnetic induction heating). This system will now be described with reference to FIG. 1.

A fixing device incorporates rotatable fixing roller 1 which is subjected to pressure contact at its top and bottom. Pressure contact of fixing roller 1 with pressure roller 2 results in nip area N. Recording paper, on which surface an unfixed toner image is formed, is caught by nip area N and conveyed, whereby the unfixed toner image on recording paper P is fixed by heat fed by fixing roller 1 and pressure applied by pressure roller 2.

Fixing roller 1 is composed of a thin wall cylindrical metal heating member which is a hollow metal conductor formed employing electroconductive magnetic substances such as iron, nickel, or magnetic stainless steel (SUS 430), namely fixing heating member cored cylinder 1'. On the peripheral surface of fixing roller cored cylinder 1', formed is heat resistant releasing layer 8 by applying silicone resins such as FEP, PFA, or PTFE, or fluororubber or fluororubber latex, or by employing a tube.

In the hollow section of fixing roller cored cylinder 1', in order to generate Joule heat by enabling the above fixing roller cored cylinder 1' to result in induced current (being eddy current), induction coil 3 is arranged which is a induction heating source resulting in a high frequency magnetic field. Induction coil 3 is arranged in the interior of a holder composed of heat resistant resins such as PPS, PEEK, or phenol resins. The holder is arranged on the interior side of fixing roller core cylinder 1', and is fixed employing a fixing unit frame (not shown) to result in non-rotation. One end of induction coil 3 is connected to alternating current power source 16.

From alternating current source 16 at voltage Vpp of 10-2,000 V and frequency f of 10-5,000 kHz, which is an induction heating source, is applied 10-100 kHz of alternating current to induction coil 3. An alternating magnetic field induced by alternating current allows the interior surface of fixing roller cylindrical core 1', which is a conductive layer to flow eddy current to generate Joule heat. Magnetic flux generated by electric current applied to coil 3, employing alternating current source 16, is lead by core 4 at a high magnetic permeability and allows fixing roller cored cylinder 1' in nip N to generate magnetic flux M as well as eddy current I. Utilizing resulting eddy current I and specific resistance of fixing roller cored cylinder 1', fixing roller cored cylinder 1' functions as a heat generator, whereby Joule heat is generated. To enhance the resulting heat generation, it is recommended to increase the number of coils of induction coil 3, to use ferrites or permalloy as core 4, of a high magnetic permeability as well as a low residual magnetic flux density, or to increase the frequency of the alternating current. When induction coil 3 is employed at a relatively high temperature, its electric resistance increases to degrade efficiency of the power source. When power is further fed as the compensation, more heat is generated, starting a vicious cycle. The surface of induction coil 3 is subjected to coating of insulating heat resistant resins. However, when heat generation of the coil is excessive, the resulting temperature exceeds the heat resistance temperatures of resins, resulting in degradation of resistance. Further, heat generated by induction coil 3 induces a temperature elevation of core 4. When the temperature exceeds Curie temperature of core 4, its magnetic permeability extremely decreases and heat generating efficiency is degraded. Consequently, temperature sensor 6 is arranged to come into contact with the surface of fixing roller 1 and the surface temperature of fixing roller 1 is automatically controlled to maintain the predetermined temperature by controlling power supply to induction coil based on the detection signals from temperature sensor 6.

It is possible to structure fixing heating member 1 and pressure roller 2 to result in a pressure contact force (being an applied pressure) of 100-300 N. Fixing temperature is preferably in the range of 140-160° C., and ripple (variation) in the above range is preferably ±4° C.

An embodiment of the present invention can be a toner including at least one toner particle which contains an inner layer and an outer layer on the inner layer, wherein a cross-sectional area ratio of the outer layer to the inner layer is about 0.05—about 0.46, and wherein a non-uniform thickness exists in the outer layer, and further the average thickness (t) taken at 5 positions as calculated by, is about 0.2—about 1.0 μm, $t=(t_1+t_2+t_3+t_4+t_5)/5$ (unit of $t_1$-$t_5$ is μm)

wherein $t_1$ represents a thickness of the thickest part of the outer layer, and $t_2$-$t_5$ each represent a thickness of a second to a fifth thickest part of the outer layer in one particle, and wherein a glass transition point Tg of the inner layer is about 2—about 45° C. lower than a glass transition point Tg of the outer layer.

The inner layer may comprise a first resin, a colorant and a releasing agent, and the outer layer may comprise a second resin. When toner particle has multi-layered structure, the inner layer is the innermost portion of the toner particle and the outer layer the outermost portion of the toner particle. For instance, when toner particle has core particle, an intermediate layer covered on the core particle, and an outermost layer on the intermediate layer, the inner layer is the core particle, and the outer layer is the outermost layer. The intermediate layer between the core and the outermost layer is not either the inner or outer layer.

Examples of the production method of the toner of the present invention will be detailed, and subsequently, produced toner will be described. Incidentally, colored particles (m) which are employed to form the inner layer constitute the inner layer of the toner particles, and outer layer forming resinous particles (s) constitute the outer layer of the toner particles. Further in this specification, particle diameter (Dv50) expresses the median size in volume particle size distribution.

<<Toner Production Method>>

Description is made for an inner layer, namely colored particles (m) to form the inner layer as well as colored particle dispersion (M), outer layer forming resinous particles (s), and outer layer resinous particle dispersion (s) containing above outer layer forming resinous particles (s), and the production process of toner particles will be detailed later.

<<Inner Layer Forming Colored Particles (m)>>

Inner layer forming colored particles (m) incorporate at least inner layer resinous particles of particle diameter (Dv50) of 2.5-9.0 m, colorants, and releasing agents.

(Method for Forming Inner Layer Forming Colored Particles (m))

It is preferable that colored particles (m) incorporating a resin and a colorant, is employed to obtain toner particles by that the colored particles (m) are coagulated, to form the inner layer of the toner particles. In practice, a method is preferred in which when inner layer forming colored particles (m) reach the specified size (2.5-9.0 μm), coagulation terminating salts are added, and after terminating coagulation, outer layer resinous particle dispersion (S) is added and outer layer forming resinous particles (s) is allowed to firmly adhere to the surface of inner layer forming colored particles (m).

(Particle Size of Inner Layer Forming Colored Particles (m))

The size of inner layer forming colored particles (m) is commonly in the range of 2.5-9.0 μm, but is preferably in the range of 3.5-7.0 μm. Herein, it is possible to determine particle diameter (Dv50) employing an electric resistance system particle size distribution measuring apparatus such as Coulter Multisizer (produced by Coulter-Beckman Co.) or SD-2000 (Sysmex Corp.).

(Variation Coefficient of Particle Diameter of Inner Layer Forming Colored Particles (m))

It is preferable to control, within 14-20(%), the variation coefficient in the volume-based particle size distribution of the inner layer forming colored particles (m). It is possible to determine the variation coefficient in the volume-based particle size distribution employing the above particle size distribution measurement apparatus. By controlling, within the range of 14-20(%), the variation coefficient in the volume-based particle size distribution of inner layer forming colored particles (m), it is possible to allow a toner to incorporate in releasing agents at a greater amount, compared to the case in which the variation coefficient is not in the above range, and it is also possible to narrow the particle size distribution. Further, the above variation coefficient is more preferably 15.5-18.5 (%). Narrow particle size distribution is preferable since it not only results in desired effects which narrow the static charge amount distribution but also it allow outer layer resinous particles (s) to be uniformly fixed with colored particles (m) without large loss.

(Average Value of Circularity of Inner Layer Forming Colored Particles (m))

It is possible to determine circularity of inner layer forming colored particles (m) in the same manner as for the average value of circularity of toner particles described below. The average value of circularity (being a shape factor) of inner layer forming colored particles (m), when the outer layer forming resinous particles are subjected to adhesion, is preferably in the range of 0.94-0.99, but is more preferably in the range of 0.963-0.981.

<<Inner Layer Forming Colored Particle Dispersion (M)>>

Methods for preparing inner layer forming colored particle dispersion (M) are not particularly limited as long as inner layer forming colored particles (m) satisfy the conditions described above. In view of firmly adhering outer layer forming resinous particles (s) on the surface of inner layer forming colored particles (m), it is preferable to prepare the same employing an emulsification coalescence method.

(ζ Potential of Inner Layer Forming Colored Particle Dispersion (M))

During adhesion of outer layer forming resinous particles (s) on the surface of inner layer forming colored particles (m), it is preferable to add inner layer forming colored particle dispersion (M) when its ζ potential reaches the range of −20 to −30 mV. It is more preferable that its ζ potential is controlled in the range of −15 to −30 mV. Herein, the value of ζ potential of inner layer forming colored particle dispersion (M) is determined employing ELS800 (produced by Otsuka Electronics Co., Ltd.).

(Solid Concentration (In Percent by Weight) of Inner Layer Forming Colored Particles (m))

Solid concentration of inner layer forming colored particle dispersion (M) of inner layer forming colored particles (m) is preferably in the range of 4-35 percent by weight, but is more preferably in the range of 7-20 percent by weight of the dispersion (M).

<<Outer Layer Resinous Particle Dispersion (S)>>

Preferably employed as outer layer forming resinous particle dispersion (S) is a water-based dispersion which is prepared in such a manner that outer layer forming resinous particles (s) prepared by polymerizing polymerizable monomers are subjected to micelle formation and then dispersed. Methods for producing outer layer forming resinous particle dispersion (S) are not particularly limited as long as resinous particles are capable of forming micelles. Examples of the preferred production methods include an emulsion polymerization method, a mini-emulsion polymerization method, and a seed polymerization method.

(pH of Outer Layer Forming Resinous Particle Dispersion (S) when Added to Inner Layer Forming Colored Particle Dispersion (M))

In order to obtain the desired effects of the present invention, the pH of outer layer resinous particle dispersion (S) is controlled to be in the preferable range of 7-12, but more preferably in the range of 8-9. Herein, with regard to measurement of the pH, the pH of outer forming layer resinous particle dispersion (S) at 25° C. is measured, employing a pH measurement apparatus such as a hydrogen electrode pH meter (produced by DKK-TOA Corp.).

(Particle Diameter and Particle Size Distribution of Outer Layer Forming Resinous Particles (s) in Outer Layer Forming Resinous Particle Dispersion (S))

In the production method of this toner, in order to allow outer layer forming resinous particles (s) to firmly adhere to inner layer forming resinous particles (m), particle diameter (Dv50) is preferably in the range of 51-240 nm. The particle diameter (Dv50) as well as the particle size distribution of outer layer forming resinous particles (s) in outer layer forming resinous particle dispersion (S) is obtained based on numeric figure determined employing a laser Doppler system measurement apparatus (for example, UPA150 produced by Microtrack Co.). Specifically, a laser beam is exposed to a dispersion and the interval of interference fringes generated by reflected light from resinous particles moving in liquid in a latex micelle state is determined and calculated, whereby a particle size distribution is determined.

(Method for Controlling Particle Diameter and Particle Size Distribution of Outer layer Forming Resinous Particles (s))

It is possible to control the particle size distribution of outer layer forming resinous particles (s), employing the methods below. In one method, in the course of production of resinous particles employing an emulsion polymerization method, two or three types of latex particles, which differ in size, are prepared by controlling the type and added amount of surface active agents, and the particle size distribution is controlled by mixing the same. For example, an addition of small amounts of surface active agents increases the particle diameter. Alternatively, when outer layer forming resinous particles are produced via a multistage method, distribution is broadened by increasing the number of polymerization stages.

(ζ Potential of Outer Layer Forming Resinous Particle Dispersion (S))

Further, when the ζ potential of inner layer forming resinous particle dispersion (M) is set in the above range, the ζ potential of outer layer forming resinous particle dispersion (S), which added to inner layer forming colored particle dispersion (M), is preferably controlled to be in the range of −30 to −100 mV, but more preferably in the range of −45 to −70 mV. By controlling the ζ potential of outer layer resinous particle dispersion (S) within the above range, it was confirmed that outer layer forming resinous particles (s) tended to migrate toward the surface of inter layer forming colored particles (m) and to be subjected to firm adhesion.

(pH of Outer Layer Forming Resinous Particle Dispersion (S))

The pH of outer layer forming resinous particle dispersion (S) may range from acidity to alkalinity immediately after preparation. However, in a process in which outer layer forming resinous particles (s) are allowed to firmly adhere onto above inner layer forming resinous particles (m), it is preferable that the pH is controlled in the range of 5-9.

<<Addition Method of Outer Layer Forming Resinous Particles (s) to Inner Layer Forming Colored Particle Dispersion (M)>>

One of the preferred embodiments is that toner particles are produced via a process in which resinous particle dispersion (S) containing outer layer forming resinous particles (s) is added to resinous particle dispersion (M) containing inner layer forming colored particles (m), and outer layer forming resinous particles (s) of a particle diameter (Dv50) in the range of 51-240 nm are allowed to firmly adhere on the surface of inner layer forming colored particles (m). Firm adhesion, as described herein, means that combining forces such as adhesion, adsorption, or electrostatic combination, which combine particles, are applied between inner layer forming colored particles (m) and outer layer forming resinous particles (s), whereby toner particles are formed and is not particularly limited to the above. In order to allow outer layer forming resinous particles (s) in outer layer forming resinous particle dispersion (S) to firmly adhere onto the surface of inner layer forming colored particles (m) so that outer layer forming resinous particles (s) do not form released particles, it is preferable that ζ potential B of above outer layer forming resinous particle dispersion (S) is in the range of −40 to −70 mV, and ζ potential A of above inner layer forming resinous particle dispersion (M) is in the range of −15 to −30 mV. When heating and stirring are continued in such a state that it is possible that aforesaid outer layer forming resinous particles (s) migrate onto the surface of inner layer forming colored particles (m), firm adhesion of outer layer forming resinous particles (s) onto inner layer forming colored particles (m) is enhanced. It is possible to confirm the progress of firm adhesion of outer layer forming resinous particles (s) onto the surface of inner layer forming colored particles (m) in such a manner that the resulting dispersion is subjected to centrifugal separation under approximately 500 g, and turbidity of the resulting liquid is visually observed. Namely, along with the progress of firm adhesion, turbidity of the resulting dispersion gradually decreases and finally it is possible to visually confirm elimination of turbidity. In such a manner, after disappearance of turbidity in the dispersion, stirring is continued until particles reach the average value (note: this definition is described below) of desired circularity. Thereafter, firm adhesion is completed by cooling the dispersion to normal temperature. The resulting toner particle dispersion is then subjected to solid-liquid separation. The resulting toner particles are subjected to washing and solid-liquid separation several times and subsequently dried, whereby toner particles are prepared.

(Solid Concentration (In Percent by Weight) of Outer Layer Forming Resinous Particle Dispersion (S))

The solid concentration of outer layer forming resinous particles (s) in outer layer forming resinous particle dispersion (S) is preferably in the range of 5 to 50 percent by weight, but is more preferably in the range of 20 to 40 percent by weight.

(Embodiment in which Inner Layer Forming Colored Particles (m) as Well as Outer Layer Forming Resinous Particles (s) Contain Releasing Agents)

In the above production method of the toner, strength of the outer layer forming resinous particles (s) layer is sufficient and incorporation of releasing agents enhances releasing properties, whereby reliability of the image forming system is enhanced. Consequently, it is preferable that inner layer forming colored particles (m) and outer layer forming resinous particles (s) incorporate the releasing agents described below. In such a case, releasing agents incorporated in the inner layer and the outer layer may be the same or different.

(Glass Transition Point of Inner Layer Forming Colored Particles (m) and Outer Layer Forming Resinous Particles (s))

The toner particles can be produced via a process in which outer layer forming resinous particles (s) are allowed to firmly adhere to the surface of inner layer forming colored particles (m). In the aforesaid process, it was discovered that by controlling the glass transition temperature (Tgm) of inner layer forming colored particles (m) and the glass transition temperature (Tgs) of outer layer forming resinous particles (s) in a predetermined range, it was possible to enhances storage stability of toner particles and simultaneously to achieve a lower temperature fixability of toner particles. As noted above, in order to achieve both effects, namely to improve the low temperature fixability of toner particles as well as to enhance storage stability of toner particles, the glass transition temperature (Tgm) of inner layer forming colored particles (m) is controlled to be 2-15° C. lower than glass transition temperature Tgs) of outer layer forming resinous particles (s). It is possible to control the glass transition point within this range by specifying the ratio of styrene monomer to butyl acrylate monomer, or each of the molecular weights.

(Method for Determining the Glass Transition Temperature)

Herein, glass transition point (Tg) was determined employing a differential scanning calorimeter DSC-7 (produced by Perkin-Elmer Corp.). The glass transition point refers to the temperature of the intersection point of the extension line of a base line below the glass transition point with the tangent showing the maximum gradient between the peak initiating portion and the top of the peak in a DSC thermograph in the glass transition region.

(Cross-Sectional Area Ratio of Outer Layer to Inner Layer and Non-Uniform Thickness of Outer Layer)

In toner particles composed of the outer layer and the inner layer, the ratio of the cross-sectional area of the outer layer portion to that of the inner layer portion is 0.05-0.46. In the toner particles composed of the inner layer and the outer layer, thickness of the outer layer is not uniform, and the average value of the thickest portion to the fifth thickest portion is 0.2-1.0 μm. Non-uniform thickness of the outer layer is formed employing a method in which the particle diameter (Dv50) of the outer layer forming resinous particles is set between 51-240 nm and is mixed with inner layer forming colored particles when their particle diameter (Dv50) is 2.5-9.0 μm, whereby an outer layer is formed via coagulation and fusion on the periphery of the inner layer. In order to control the non-uniform thickness of the outer layer, it is preferable that an outer layer resinous particle dispersion is divided to 2-8 portions but preferably 3-5 portions, and then charged.

In the case in which the non-uniform thickness of the outer layer is controlled, the non-uniform thickness decreases when the frequency of divisional addition increases or dripping addition is continuously performed. In addition, it is possible to control the non-uniform thickness based on the particle size distribution of the outer layer forming resinous particles.

It is possible to control the cross-sectional area ratio of the outer layer to the inner layer utilizing the added amount and the firm adhesion ratio of the outer layer forming resinous particles. An increase in the firm adhesion ratio to make the added amount proportional to the cross-sectional area ratio may be performed by controlling the ζ potential of the outer layer dispersion between −40 and −60 mV.

The cross-section of toner particles is observed and determined as follows. Toner particles are dispersed into resins to be buried. Thereafter, slices are prepared employing a cutter such as an ultra-microtome.

Subsequently, 1) images are captured by a high resolution transmission type electron microscope, 2) viscoelastic images captured by a scanning type probe microscope 3) are transmitted to an image analysis apparatus, whereby the cross-sectional shape is converted to numerical values. In the interface of the inner layer and the outer layer, image 1) and image 2) are overlapped, and if desired, the resulting image is drawn employing image analysis software. Thereafter, determined are the cross-sectional area of the outer layer with respect to the inter layer as well as the non-uniform thickness average at 5 points. Alternatively, without using the image analysis apparatus, an image is transferred onto a sheet and the inner layer and the outer layer are cut out, whereby it is possible to determine the weight or length of the cut-out pieces. The above determination is performed for at least 10 random toner particles, and the results are represented by arithmetical mean.

Glass transition points of the inner layer and the outer layer can be measured by which the inner layer particle on which any layer are not adhered, and the composition to form outer layer are separately measured by employing a differential scanning calorimeter DSC-7 (produced by Perkin-Elmer Corp.).

It is also possible to confirm difference between glass transition points from the toner particle by employing the scanning type probe microscope. In such case, a scanning type probe microscope SPI3800N environment controlling type unit SPA300HV (produced by Seiko Instrument Co.) can be used. Measurement conditions are as follows.

Micro-viscoelastic mode (VE-AFM): frequency 3-5 kHz, amplitude 4-6 mm, a measurement area of about 10 μm×about 10 μm, measurement of an appropriate area including one toner particle. A sample stage is heated from normal temperature at a rate of 5° C./minute, and temperature at the time when the phase difference of each of the cantilevers results in sudden change is designated as the glass transition point.

The toner production process will now be described.

(Production of Inner Layer Forming Colored Particles (m))

Herein, specifically described is a production method of aforesaid inner layer forming colored particles (m). Colored particles (m) to form the inner layer are colored particles of a particle diameter (Dv50) of 2.5-9 m incorporating at least a resin and a colorant. Employed in inner layer forming colored particles may be resins prepared by polymerizing the polymerizable monomers described below as well as various types of commercially available resins. Further, when resins are prepared via a polarization reaction, colorants as well as releasing agents may simultaneously be present during the reaction. Alternatively, colorants as well as releasing agents may be added to resins prepared via polymerization reaction. Still further, conventional reaction conditions known in the art are applicable. It is preferable that polymerization is performed only after releasing agents are dissolved in polymerizable monomers. Further, in order to control the resulting molecular weight distribution, it is preferable that multistage polymerization is performed in the presence of once polymerized resinous particles while varying the amount of chain transfer agents.

<<Production Method of Inner Layer Forming Colored Particles>>

It is preferable that inner layer forming colored particles are prepared in such a manner that inner layer forming resinous particles and colorant particles are salted out, coagulated, and fused (note: salting-out and fusion are simultaneously performed). However, coagulating and fusing the particles can be separately taken place. In this salting-out, coagulation and fusion, internal agent particles (at a number average particle diameter of 10-1,000 nm) such as charge controlling agents may be salted out, coagulated, and fused together with composite resinous particles and colorant particles.

Colorant particles may be subjected to surface modification. Herein, employed as surface modifying agents may be those known in the art. Colorant particles are subjected to salting-out, coagulation, and fusion treatments in a aqueous media dispersed state. Listed as an aqueous medium in which colorant particles are dispersed is an aqueous solution in which surface active agents are dissolved at a higher concentration than their critical micelle concentration (CMC).

Homogenizers employed for dispersing colorant particles are not particularly limited. However, preferably listed are medium type homogenizers such as those having a stirrer fitted to a high speed rotating rotor, "CLEARMIX" (produced by M TECHNIQUE), ultrasonic homogenizers, mechanical homogenizers, Manton Gaulin homogenizers, pressure homogenizers, Getzmann Mill, and diamond fine mills.

In order to salt out, coagulate, and fuse inner layer resinous particles to colorant particles, it is preferable that coagulants are added at least in the amount of a critical coagulation concentration to a dispersion in which inner layer forming resinous particles and colorant particles are dispersed, and the resulting dispersion is heated to a higher temperature than the glass transition temperature (Tg) of inner layer forming resinous particles. It is more preferable that coagulation terminating agents are added during the stage in which the diameter of composite resinous particles reaches the desired value. Employed as above coagulation terminating agents are univalent metal salts, in which sodium chloride is preferably employed.

It is proposed that a suitable temperature range for salting-out, coagulation, and fusion is (Tg+10° C.)-(Tg+50° C.) but is most preferably (Tg+15° C.)-(Tg+40° C.). Further, in order to effectively perform fusion, organic solvents, which are infinitely soluble in water, may be added.

Herein, listed as "coagulants" employed during salting-out, coagulation, and fusion may be alkaline metal salts, as well as alkaline earth metal salts.

"Salting-out, coagulation, and fusion", as described herein, refer to simultaneous occurrence of salting-out (coagulation of particles) and fusion (disappearance of the interface between particles) and the act which results in simultaneous occurrence of salting-out and fusion. In order to result in simultaneous occurrence of salting-out and fusion, it is preferable that particles (inner layer forming resinous particles as well as colorant particles) are coagulated at a higher temperature than the glass transition temperature (Tg) of resins constituting inner layer forming resinous particles.

It is preferable that the toner is prepared in such a manner that inner layer forming resinous particles are formed in the absence of colorants, and a colorant particle dispersion is added to the inner layer forming resinous particles to salt out, coagulate, and fuse aforesaid inner layer forming resinous particles and colorant particles.

As noted above, by preparing inner layer forming resinous particles in a system containing no colorants, polymerization reaction to prepare composite resinous particles is allowed. Consequently, the electrostatic image developing toner of the present invention is capable of minimizing generation of staining of fixing devices and images due to toner accumulation while excellent off-setting resistance is not adversely affected.

Further, a polymerization reaction to prepare inner layer forming resinous particles is completely performed. As a result, it is possible to minimize residual monomers and oligomers in the resulting toner particles, and to minimize unpleasant odor during the heat fixing process of the image forming method employing the aforesaid toner.

In addition, since the surface characteristics of the resulting toner particles are uniform and the resulting charge amount distribution is narrow, it is possible to form images of excellent resolution over an extended period of time. By employing such a toner, which exhibits uniform composition, molecular weight, and surface characteristics among toner particles, in an image forming method including a fixing process employing a contact heating system, it is possible to improve off-setting resistance and to enhance winding resistant characteristics, and also to prepare images of optimal glossiness.

<<Releasing Agent>>

The releasing agent usable for the toner is explained.

Although the toner can contain a releasing agent in a color particle which form an inner layer, it may be desirable to contain the releasing agent a resin particle(s) for outer layers. A content rate of a releasing agent is usually considered as 1-30 weight % to toner, and is preferably a range of 2 to 20 weight %, and still more preferably 3-15 weight %. As the releasing agent, low molecular weight polypropylene (number average molecular weight=1500 to 9000), low molecular weight polyethylene, etc. may be added, as a desirable releasing agent, an ester type compound expressed with the following general formula is desirable.

$$R_1—(OCO—R_2)_n \qquad \text{General formula}$$

In the formula, n is an integer of from 1 to 4, preferably from 2 to 4, more preferably from 3 to 4, and most preferably 4.

R1 and R2 are each a hydrocarbon group which may have a substituent.

R1 has 1 to 40 carbon atoms, preferably has 1 to 20 carbons atoms, and more preferably has 2 to 5 carbons atoms; R2 has 1 to 40 carbon atoms, preferably has 16 to 30 carbons atoms, and more preferably 18 to 26 carbon atoms. Specific examples of the ester compounds are shown below. However, the invention is not limited to these examples.

1)

$$CH_3-(CH_2)_{12}-COO-(CH_2)_{17}-CH_3$$

2)

$$CH_3-(CH_2)_{18}-COO-(CH_2)_{17}-CH_3$$

3)

$$CH_3-(CH_2)_{20}-COO-(CH_2)_{21}-CH_3$$

4)

$$CH_3-(CH_2)_{14}-COO-(CH_2)_{19}-CH_3$$

5)

$$CH_3-(CH_2)_{20}-COO-(CH_2)_6-O-CO-(CH_2)_{20}-CH_3$$

6)

$$CH_3-(CH_2)_{20}-COO-(CH_2)_2-\underset{}{\overset{CH_3}{\overset{|}{C}}}H-CH_2-O-CO-(CH_2)_{20}-CH_3$$

7)

$$CH_3-(CH_2)_{22}-COO-(CH_2)_2-\overset{CH_3}{\overset{|}{C}}H-CH_2-O-CO-(CH_2)_{22}-CH_3$$

8)

$$CH_3-(CH_2)_{22}-COO-CH_2-\underset{CH_3}{\overset{CH_3}{\overset{|}{\underset{|}{C}}}}H-CH_2-O-CO-(CH_2)_{22}-CH_3$$

9)

$$CH_3-(CH_2)_{26}-COO-CH_2-\underset{CH_3}{\overset{CH_3}{\overset{|}{\underset{|}{C}}}}H-CH_2-O-CO-(CH_2)_{26}-CH_3$$

10)

$$\begin{array}{l} CH_2-O-CO-(CH_2)_{26}-CH_3 \\ | \\ CH-O-CO-(CH_2)_{26}-CH_3 \\ | \\ CH_2-O-CO-(CH_2)_{26}-CH_3 \end{array}$$

11)

$$\begin{array}{l} CH_2-O-CO-(CH_2)_{22}-CH_3 \\ | \\ CH-O-CO-(CH_2)_{22}-CH_3 \\ | \\ CH_2-O-CO-(CH_2)_{22}-CH_3 \end{array}$$

12)

$$\begin{array}{l} CH_2-OH \\ | \\ CH-O-CO-(CH_2)_{26}-CH_3 \\ | \\ CH_2-O-CO-(CH_2)_{26}-CH_3 \end{array}$$

13)

$$\begin{array}{l} CH_2-OH \\ | \\ CH-O-CO-(CH_2)_{22}-CH_3 \\ | \\ CH_2-O-CO-(CH_2)_{22}-CH_3 \end{array}$$

14)

$$\begin{array}{l} CH_2-OH \\ | \\ CH-OH \\ | \\ CH_2-O-CO-(CH_2)_{26}-CH_3 \end{array}$$

-continued

15)

$$\begin{array}{l} CH_2-OH \\ | \\ CH-OH \\ | \\ CH_2-O-CO-(CH_2)_{22}-CH_3 \end{array}$$

16)

$$CH_3-(CH_2)_{26}-COO-CH_2-\overset{CH_3}{\overset{|}{C}}-CH_2-O-CO-(CH_2)_{26}-CH_3$$
$$CH_2-O-CO-(CH_2)_{26}-CH_3$$

17)

$$CH_3-(CH_2)_{20}-COO-CH_2-\overset{CH_2CH_3}{\overset{|}{C}}-CH_2-O-CO-(CH_2)_{20}-CH_3$$
$$CH_2-O-CO-(CH_2)_{20}-CH_3$$

18)

$$CH_3-(CH_2)_{26}-COO-CH_2-\overset{CH_2-O-CO-(CH_2)_{26}-CH_3}{\overset{|}{C}}-CH_2-O-CO-(CH_2)_{26}-CH_3$$
$$CH_2-O-CO-(CH_2)_{26}-CH_3$$

19)

$$CH_3-(CH_2)_{20}-COO-CH_2-\overset{CH_2-O-CO-(CH_2)_{20}-CH_3}{\overset{|}{C}}-CH_2-O-CO-(CH_2)_{20}-CH_3$$
$$CH_2-O-CO-(CH_2)_{20}-CH_3$$

20)

$$CH_3-(CH_2)_{18}-COO-CH_2-\overset{CH_2-O-CO-(CH_2)_{18}-CH_3}{\overset{|}{C}}-CH_2-O-CO-(CH_2)_{18}-CH_3$$
$$CH_2-O-CO-(CH_2)_{18}-CH_3$$

21)

$$CH_3-(CH_2)_{16}-COO-CH_2-\overset{CH_2-O-CO-(CH_2)_{16}-CH_3}{\overset{|}{C}}-CH_2-O-CO-(CH_2)_{16}-CH_3$$
$$CH_2-O-CO-(CH_2)_{16}-CH_3$$

22)

$$CH_3-(CH_2)_{20}-COO-CH_2-\overset{CH_2-O-CO-CH_3}{\overset{|}{C}}-CH_2-O-CO-CH_3$$
$$CH_2-O-CO-CH_3$$

[Filtration•Washing Process]

The filtration•washing process is a filtration process to separate the toner particles from the toner particle dispersion obtained in the above process and a washing process to remove adhered substances such as the surfactant and the coagulator from the separated toner particles as a cake like mass. As the filtration method, usual methods such as a centrifugal method, a vacuum filtration method using a Nutsche funnel, and a filter press are applicable without any limitation.

[Drying Process]

This process is a process to dry the toner particles. As the drying machine to be employed in this process, a spray drier, a vacuum freeze drying machine and a vacuum drier are employable, and a standing rack drying machine, a moving rack drying machine, a fluid bed drying machine, a rotary drying machine and a stirring drying machine are preferably employed. The moisture content of the dried toner particles is preferably not more than 5% by weight and more preferably not more than 2% by weight. Incidentally, when toner particles to which drying process was carried out are aggregating with weak attracting power among the particles, the aggregate may be subjected to a pulverizing process. Here, as a pulverization processing unit, a mechanical pulverization apparatus, such as a jet mill, a Henschel mixer, a coffee mill, and a food processor, may be used.

Polymerizable monomer capable to form the toner particles is explained.

(1) Hydrophobic Monomer

As the hydrophobic monomer constituting the monomer component, usually known monomers can be employed without any limitation. The monomer may be employed solely or in combination of two or more kinds thereof for satisfying required properties.

In concrete, aromatic mono-vinyl type monomers, (meth) acrylate type monomers, vinyl ester type monomers, vinyl ether type monomers, mono-olefin type monomers, di-olefin type monomers and halogenated olefin type monomers are employable.

Examples of the aromatic vinyl type monomer are styrene type monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

As the acrylate type monomers, acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl b-hydroxyacrylate, propyl g-aminoacrylate, stearyl methacrylate, dimethylaminoethyl methacrylate and diethylaminoethyl methacrylate are cited.

Listed as vinyl ester based monomers are vinyl acetate, vinyl propionate, and vinyl benzoate.

Listed as vinyl ether based monomers are vinyl methyl ether, vinyl ethyl ether, vinyl isobutyl ether, and vinyl phenyl ether.

Listed as monoolefin based monomers are ethylene, propylene, isobutylene, 1-butene, 1-pentene, and 4-methyl-1-pentene.

Listed as diolefin based monomers are butadiene, isoprene, and chloroprene.

(2) Crosslinkable Monomer

A crosslinkable monomer may be added to improve the properties of the resin particle. As examples of the crosslinkable monomers, ones having two or more unsaturated bonds such as divinylbenzene, divinylnaphthalene, divinyl ether, diethylene glycol methacrylate, ethylene glycol dimethacrylate and diallyl phthalate are cited.

(3) Monomer Having an Acidic Polar Group

As the monomers having an acidic polar group, (a) α,β-ethylenic unsaturated compounds each having a carboxyl group (—COOH), and (b) α,β-ethylenic unsaturated compounds each having a sulfonic group (—SO3) can be cited.

Examples of α,β-ethylenic unsaturated compounds each having a group (—COOH) of (a) are acrylic acid, methacrylic a acid, a fumalic acid, maleic acid, itaconic acid, cinnamic acid, mono-butyl maleate, mono-octyl maleate and their salts of a metal such as Na and Zn.

Examples of α,β-ethylenic unsaturated compounds each having a sulfonic group of (b) are sulfonated styrene and Na salt thereof, allylsulfosuccinic acid, octyl allylsulfosuccinate and their Na salts.

An initiator (it is also called a polymerization initiator) used for polymerization of a polymerizable monomer is explained.

Polymerization initiators can be optionally employed as long as it is water soluble. For example, persulfates such as potassium persulfate and ammonium persulfate, azo compounds such as 4,4'-azo-bis-4-valerate and its salt and 2,2'-azo-bis(2-aminopropane) salt, and peroxide compounds such as hydrogen peroxide and benzoyl peroxide can be cited. The above-mentioned polymerization initiator can be employed as redox initiators in combination with a reducing agent according to necessity. By employing said redox based initiators, polymerization activity increases whereby it is possible to lower polymerization temperature and a decrease in polymerization time can be expected.

Selected as said polymerization temperature may be any reasonable temperature, as long as it is higher than or equal to the lowest radical forming temperature. For example, the temperature range of 50 to 80° C. is employed.

Further, when polymerization initiators, which work at normal temperature are employed in combination, such as a combination of hydrogen peroxide and a reducing agent (ascorbic acid), it is possible to carry our polymerization at temperature equal to or near to room temperature.

In the present invention, it is possible to use conventionally the well-known chain transfer agent generally used for the purpose of adjusting the molecular weight of the resin particles produced by which a polymerizable monomer polymerizes. Although a chain transfer agent in particular is not limited, a compound having a mercapto group is used preferably as a chain transfer agent, because toner with sharp molecular weight distribution is obtained with the compound having a mercapto group, and conservation, fixing strength, and offset-proof nature becomes excellent. For example, a compound which has mercapto groups, such as octane thiol, dodecane thiol, and tert-dodecane thiol, can be used. Moreover, as a desirable compound, thioglycolic-acid ethyl, thioglycolic-acid propyl, n-butyl thioglycolate, the thioglycolic-acid t-butyl, 2-ethylhexyl thioglycolate, a thioglycolic-acid octyl; a thioglycolic-acid decyl, a thioglycolic-acid dodecyl, the thioglycolic-acid ester of ethylene glycol, the thioglycolic-acid ester of neopentylglycol, the thioglycolic-acid ester of pentaerythritol, etc. can be mentioned, for example. Especially, n-octyl-3-mercaptopropionic acid ester is preferably used from a viewpoint which controls bad smell at the time of toner heating fixing.

(Colorant)

A colorant is explained.

Unless a coloring material can set up a color of toner suitably as needed and the effect of a present invention is not hindered, a well-known coloring material can be used. Generally, by using toner of each of four black color (hereinafter, merely referred as toner) of yellow, a magenta, cyan for developing electrostatic charge image, a color picture image is formed in many cases. However, as for a colorant for these toner, it is desirable from a viewpoint of the uniformity improvement in charging of toner, the colorant is subjected to salting-out, coagulation, and fusion together with resin particles so as to be contained in the resin particles, at the time of salting-out, coagulation, and fusion of the compound resin particles during toner production.

Various inorganic pigments, organic pigments and dyes can be listed as the colorant (color particle supplied for salting-out, coagulation, and fusion with resin particles for an inner layer). As the inorganic pigment, a well-known black pigment, a well-known magnetic particle, etc. are may be listed.

For example, carbon black such as furnace black, channel black, acetylene black, thermal black and lamp black is listed as the black pigment used for preparation of a black toner, and magnetite and ferrite are employable as magnetic powder.

These inorganic pigments can be employed solely or in a combination of plural kinds thereof.

Moreover, it is desirable that the content in the toner of an inorganic pigment is in a range of 2-20 weight %, it is still more desirable that it is in a range of 3-15 weight %.

When said inorganic pigments are employed as magnetic toner, it is possible to add said magnetite.

In this case, from the viewpoint of providing the specified magnetic characteristics, said magnetite is preferably added to toner in an amount of 20 to 120 percent by weight.

Usually known organic pigments and organic dyes are employable. Concrete examples of the organic pigments and organic dyes are described below.

As an organic pigment for magenta or red used for preparation of magenta toner,

C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222 may be used.

As an organic pigment the orange used for preparation of yellow toner, or for yellow, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155 and C. I. Pigment Yellow 156 may be used Pigments for green or blue color are, for example, C. I. Pigment Blue 15, C. I. Pigment Blue 15:2, C. I. Pigment Blue 15:3, C. I. Pigment Blue 16, C. I. Pigment Blue 60 and C. I. Pigment Green 7.

Moreover, employed as dyes, Solvent Red 1, C.I. Solvent Red 49, C.I. Solvent Red 52, C.I. Solvent Red 58, C.I. Solvent Red 63, C.I. Solvent Red 111, and C.I. Solvent Red 122; C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, and C.I. and Solvent Yellow 162; C.I. Solvent Blue 25, C.I. Solvent Blue 36, C.I. Solvent Blue 60, C.I. Solvent Blue 70, C.I. Solvent Blue 93, C.I. Solvent Blue 95 may by used. Such dye may be used independently and may be used as mixture of plural dyes.

These organic pigments or organic dyes can be employed solely or in a combination of plural kinds thereof. Moreover, respectively, it is desirable that the content of above-mentioned organic pigment or dye in the toner in a range of 2-20 weight %, and it is still more desirable that it is in a range of 3-15 weight %.

<<Electric Charge Control Agent>>

Toner particles may contain an electric charge control agent. As for the electric charge control agent contained in toner particles, it is desirable to contain it in an outer layer of the toner particles. Listed as specific examples are nigrosine based dyes, metal salts of naphthenic acid or higher fatty acids, alkoxylated amines, quaternary ammonium salts, azo based metal complexes, metal salicylates or metal complexes thereof.

(Toner Diameter)

It is desirable that number average particle diameter (D1) of toner is 3-10 m, and it is more desirably 3-8 μm. This particle diameter is controllable by the concentration of a coagulator, the added amount of an organic solvent, fusion time, and the composition of a polymer in the production method of the toner explained in full detail later. When the number average particle diameter (D1) is 3-10 μm, in a fixing process, toner fine particles which has a large adhesion force and causes offset by jumping and adhering to a heating head member becomes little, moreover, transfer efficiency becomes high, the image quality of halftone improves, and image quality, such as a thin-line and a dot, improves.

The number average particle diameter (D1) of toner can be measured using Coulter counter TA-II, a Coulter Multi-SAIZA (both made in by Coulter-Beckman Co.), SD2000 (made by Sysmex Corp.), etc. In the invention, the number average diameter of the toner particles are measured and calculated by employing Coulter Multisizer connected to a personal computer through an interface for outputting the particle diameter distribution, manufactured by Nikkaki Co., Ltd. The volume and the number of particles were calculated by measuring the number distribution of toner having a diameter of 2 μm or more (for example 2-40 μm) by the use of an aperture of 100 μm in the Coulter Multisizer.

(Average Value of the Circularity of Toner Particles)

With regard to toner shape, when measuring 2000 or more toner particles with a particle diameter of 1 μm or more, the average value of circularity (shape coefficient) shown by the following formula is 0.954-0.992.

Circularity=(circumference length of equivalent circle)/(circumference length of a projection image of a toner particle)=$2\pi\times$(projection area of a particle/$\pi$)$^{1/2}$/(circumference length of a projection image of a toner particle)

Here, the equivalent circle is a circle which has the same area as a projection image of a toner particle, and a circle equivalent diameter is the diameter of the equivalent circle. Incidentally, as a measuring method of the above-mentioned circularity, it can be measured by FPIA-2000 (made by Sysmex Corp.).

At this time, the circle equivalent diameter is defined by the following formula.

Circle equivalent diameter=$2\times$(projection area of particles/$\pi$)$^{1/2}$ (Volume Coefficient of Variation of Toner)

The volume particle distribution as well as the volume variation coefficient of the toner is measured employing a Coulter Counter TA-11 or a Coulter Multisizer (both manufactured by Coulter Co.). In the invention, volume particle distribution and the volume variation coefficient are measured and calculated by employing Coulter Multisizer connected to a personal computer through an interface for outputting the particle diameter distribution, manufactured by Nikkaki Co., Ltd. The size distribution as well as the median diameter were calculated by measuring the volume distribution of toner having a diameter of 2 μm or more by the use of an aperture of 100 μm in the Coulter Multisizer. The volume particle size distribution, as described herein, represents the relative frequency of toner particles with respect to the particle diameter, and particle diameter (Dv50) expresses the median size in volume particle size distribution. The volume variation coefficient in the volume particle size distribution of toner is calculated employing the formula described below:

$$\text{Volume variation coefficient}(\%)=(S_2/D_n)\times 100$$

wherein S represents the standard deviation in the volume particle size distribution and Dn represents the particle diameter (Dv50) (μm).

It is desirable that the volume variation coefficient of toner particles which constitute the toner is 27% or less, and more preferably 25% or less. The reason to adjust a volume variation coefficient to be 27% or less is for making the charging amount distribution sharp and for making transfer efficiency high and for raising image quality, similar to the variation coefficient of a shape coefficient of the above-mentioned toner particles.

In particular, it is desirable that the coefficient of variation in the volume basis particle size distribution of toner is 10.1-22.6%.

The method of controlling the volume variation coefficient in toner is not limited. For example, employed may be a method in which toner particles are classified employing forced air. However, in order to further decrease the volume variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the volume variation coefficient in the volume particle size distribution to not more than 27%, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant volume particle size distribution is broadened. Accordingly, the particle size distribution of the toner, which is obtained by polymerizing the resultant oil droplets, is also broadened. Therefore classifying operation may be employed.

<<External Additive Agent>>

The external additive agent usable for the toner is explained.

As inorganic fine particles usable as the external additive agent, a conventionally-known one can be listed. Specifically, fine particles of silica, titanium, and alumina may be preferably employed. As for these inorganic matter fine particles, it is desirable that it is hydrophobicity.

In concrete, the silica fine particle such as R-805, R-976, R-974, R-972, R-812 and R-809 each manufactured and marketed by Nippon Aerosil Co., Ltd., HVK-2150 and H-200 manufactured by Hoechst Co., Ltd., TS-720, TS-530, TS-610, H-5 and MS-5 each manufactured and marketed by Cabot Co., Ltd., are cited.

As the titan fine particle, for example, T-805 and T-604, each manufactured and marketed by Nippon Aerosil Co., Ltd., MT-100S, AT-100B, MT-500BS, MT-600, MT-600SS and JA-1 each manufactured and marketed by TAYCA Corp., Ltd., TA-300SI, TA-500, TAF-130, TAF-510 and TAF-510T each manufactured and marketed by Fuji Titan Co., Ltd., and IT-S, IT-OA, IT-OB and IT-OC manufactured and marketed by Idemitsu Kosan Co., Ltd., are cited.

As the alumina fine particle, for example, RFY-C and C-604 each manufactured and marketed by Nippon Aerosil Co., Ltd., and TTO manufactured and marketed by Ishihara Sangyo Co., Ltd., are cited.

The same addition process as above-mentioned smoothing material can be applied to the above-mentioned external additive agent. Usually known various kinds of mixer such as a tabular mixer, a Henschel mixer, a nauter mixer and a V type mixer are applicable as the adding apparatus used to add the external additive.

(Developer)

The developer used for the present invention is explained.

The toner of a present invention is used as one component developer or two-component developer. When using the toner of the present invention as one component developer, the toner of the present invention can be used as a nonmagnetic one component developer or a magnetic one component developer which contains magnetic particle of 0.1 μm to 0.5 μm in toner. Moreover, it can be used as a two-component developer by being mixed with carrier. In this case, a well-known material is used as a magnetic particle of a carrier, such as an alloy of metals, such as iron, ferrite, and magnetite, and metals, such as an aluminum and lead. Especially ferritic particles are desirable. The magnetic particle is preferably one having a particle diameter (Dv50) of from 15 to 100 μm, and more preferably from 25 to 80 μm. The measurement of the particle diameter (Dv50) can be performed by a laser diffraction particle size distribution measuring apparatus HELOS, manufactured by Sympatec Co., Ltd., having a wet type dispersion means. As the carrier, a magnetic particle coated with resin and a resin dispersed type carrier composed of magnetic particles dispersed in the resin are preferred. Though the resin composition for coating is not specifically limited, for example, olefin type resins, styrene type resins, styrene-acryl type resins, silicone type resins, ester type resins or fluorine-containing polymer type resins are employable. As the resin for constituting the resin dispersed type carrier, known ones can be employed without any limitation, for example, styrene-acryl type resins, polyester resins, fluorinated type resins and phenol resins are usable.

EXAMPLES

The present invention will now be described with reference to examples; however, the present invention is not limited thereto.

Example 1

After preparing each of inner layer forming colored particle dispersion (M1) and outer layer forming resinous particle dispersion (S1), the above inner layer forming colored particle dispersion (M1) and the above outer layer forming resinous particle dispersion (S1) were blended and outer layer forming resinous particles were allowed to firmly adhere onto the inner layer forming colored particles, whereby Toner 1 was prepared.

(Preparation of Toner 1)

1. Production of Outer Layer Forming Resinous Particles (s1)

Outer layer forming resinous particle dispersion (S1), containing outer layer forming resinous particles s1, which were allowed to adhere onto the surface of inner layer forming colored particles, was prepared.

(Polymerizable Monomer Solution 1-1-1)

The composition below was designated as Polymerizable Monomer Solution 1-1-1.

| | |
|---|---|
| Styrene | 70.1 g |
| n-Butyl acrylate | 19.9 g |
| Methacrylic acid | 10.0 g |

In a 5,000 ml separable flask fitted with a stirrer, a thermal sensor, and a nitrogen inletting device, 7.08 g of an anionic surface active agent (102: $C_{12}H_{25}OsO_3Na$) was dissolved in 3,010 g of ion-exchanged water. While stirring under a flow of nitrogen, the interior temperature was raised to 80° C., whereby a surface active agent solution was prepared. Added to the above surface active agent was a polymerization initiator solution which was prepared by dissolving 9.2 g of a polymerization initiator (potassium persulfate: KPS) in 200 g of ion-exchanged water, and the temperature of the resulting mixture was maintained at 75° C. Thereafter, above Polymerizable Monomer Solution 1-1-1 was dripped over a period of one hour. After the dripping, the resulting system was heated while stirring at 75° C. over a period of two hours, polymerization (first stage polymerization) was performed, whereby resinous particles were prepared, which was designated as "Outer layer Forming Resinous Particles (1-1-1). Resinous particles constituting Outer Layer Forming Resinous Particles (1-1-1) exhibited a molecular weight peak of 35,000.

(Polymerizable Monomer Solution 1-1-2)

Added to the polymerizable monomer mixed solution below, in a flask fitted with a stirrer, was 96.0 g of a releasing agent (Exemplified Compound (19)), and was dissolved while heated to 80° C. The resulting solution was designated as Polymerizable Monomer Solution 1-1-2.

| | |
|---|---|
| Styrene | 122.9 g |
| n-Butyl acrylate | 49.7 g |
| Methacrylic acid | 16.3 g |

In a 5,000 ml separable flask fitted with a stirrer, a thermal sensor, and a cooling pipe, 5.7 g of anionic surface active agent (101: $C_{12}H_{25}(OCH_2CH_2)OSO_3Na$) was dissolved in 1,340 g of ion-exchanged water, whereby a surface active agent solution was prepared. After heating the above surface active agent solution to 80° C., it was mixed with Polymerizable Monomer Solution 1-1-2. The resulting mixture was dispersed over a period of two hours, employing a mechanical type homogenizer "CLEARMIX" (produced by M TECHNIQUE) fitted with a circulation channel, and a dispersion (an emulsion) containing emulsified particles (oil droplets) of a dispersed particle diameter of 646 nm was prepared. Subsequently, added were 1,460 ml of ion-exchanged water, a polymerization initiator solution which was prepared by dissolving 6.51 g of a polymerization initiator (potassium persulfate: KPS), and 0.75 g of n-octyl-3-mercaptopropionic acid ester were added to Outer Layer Forming Resinous Particles (1-1-1) and while stirring, the resulting system underwent polymerization (second stage polymerization) at 80° C. over a period of three hours, whereby resinous particles, which Outer Layer Forming Resinous Particles (1-1-1) were employed as a raw material, was prepared, which was designated as "Outer Layer Forming Resinous Particles (1-1-2).

Added to Outer Layer Forming Resinous Particles (1-1-2) prepared as above was a polymerization initiator solution which was prepared by dissolving 8.87 g of a polymerization initiator (KPS) in 346 ml of ion-exchanged water, and subsequently, under the temperature condition of 80° C., Polymerizable Monomer solution 1-1-3 was dripped over a period of one hour.

| | |
|---|---|
| Styrene | 322.3 g |
| n-Butyl acrylate | 121.9 g |
| Methacrylic acid | 35.5 g |
| n-Octyl-3-mercaptopropionic acid ester | 9.55 g |

After the dripping, while stirring, polymerization (third stage polymerization) was performed over a period of two hours. Thereafter, the resulting mixture was cooled to 28° C., whereby the dispersion of Outer Layer Forming Resinous Particles s1 was prepared which employed Outer Layer Forming Resinous Particles (1-1-2) as a raw material. The resulting resinous particle dispersion was designated as Outer Layer Resinous Particle Dispersion (S1).

A sample was collected from the above-dispersion and dried. Thereafter, glass transition temperature Tgs was determined. In practice, a differential scanning calorimeter was employed. The sample was heated to 100° C. and was allowed to stand at that temperature for three minutes. Thereafter, the sample was cooled to room temperature at a rate of 10° C./minute. Subsequently, under measurement of the sample at a temperature elevation rate of 10° C./minute, the intersection point of the extension line of the base line below the glass transition point with the tangent of the base line after the inflection point was determined and designated as the glass transition point. Employed as a measurement apparatus was DSC-7, produced by Perkin Elmer Corp. Table 1 shows the measurement results. Incidentally, outer layer forming resinous particles s1 exhibited three peaks at 80,000, 35,000, and 17,000 in terms of molecular weight, and their weight average molecular weight was 35,000.

2. Production of Inner Layer Forming Colored Particles (m1)

2-1) Production of Inner Layer Forming Resinous Particles Used as a Raw Material for Inner Layer Forming Colored Particles (m1)

(Polymerizable Monomer Solution 2-1-1)

In a flask fitted with a stirrer, 96.0 g of a releasing agent (Exemplified Compound (19)) was added to a solution consisting of the following mixture of polymerizable monomers. The resulting mixture was heated to 80° C. and dissolved. The resulting mixture was designated as Polymerizable Monomer solution 2-1-1.

| | |
|---|---|
| Styrene | 172.9 g |
| n-Butyl acrylate | 55.0 g |
| Methacrylic acid | 23.1 g |

In a 5,000 ml separable flask fitted with a stirrer, a thermal sensor, and a cooling pipe, 2.5 g of the following anionic surface active agent (101: $C_{12}H_{25}(OCH_2CH_2)OsO_3Na$) was dissolved in 1,340 g of ion-exchanged water, whereby a surface active agent solution was prepared. After heating the above surface active agent solution to 80° C., it was mixed with Polymerizable Monomer solution 2-1-1. The resulting mixture was dispersed over a period of two hours, employing a mechanical type homogenizer, "CLEARMIX" (produced by M TECHNIQUE) fitted with a circulation channel, and a dispersion (an emulsion) containing emulsified particles (oil droplets) of a dispersed particle diameter of 482 nm was prepared.

Subsequently, after adding 1,460 ml of ion-exchanged water, a polymerization initiator solution which was prepared by dissolving 7.5 g of a polymerization initiator (potassium persulfate: KPS) in 142 ml of ion-exchanged water, and 6.74 g of n-octanethiol were added. While stirring, the resulting system was heated to 80° C. over a period of three hours, to undergo polymerization (first stage polymerization), whereby inner layer forming resinous particles (high molecular weight resinous particle dispersion) was prepared, which was designated as "Inner Layer Resinous Particles (2-1-1).

Subsequently, added was a polymerization initiator solution which was prepared by dissolving 11.6 g of a polymerization initiator (KPS) in 220 ml of ion-exchanged water, and at 80° C., Polymerizable Monomer Solution 2-1-2 below was dripped over a period of one hour.

| | |
|---|---|
| Styrene | 291.2 g |
| n-Butyl acrylate | 132.2 g |
| Methacrylic acid | 42.9 g |
| n-Octanethiol | 7.51 g |

After the dripping operation, polymerization (second stage polymerization) was performed over a period of two hours while stirring and heating. Thereafter, the resulting products were cooled to 28° C., whereby Inner Layer Forming Resinous Particles (2-1-2) was obtained which used Inner Layer Forming Resinous Particles (2-1-1) as a raw material.

2-2) Coagulation Process of Inner Layer Forming Colored Particles (m1)

By employing the colorant dispersion described below and the aforesaid Inner Layer Forming Resinous Particles (2-1-2) dispersion, colorant particles were coagulated together with Inner Layer Forming Resinous Particles (2-1-2).

(Preparation of Colorant Dispersion)

While stirring, 50.0 g of an anionic surface active agent (101) was dissolved in 1,600 ml of ion-exchanged water, and to the resulting solution, while stirring, was added 280.0 g of C.I. Pigment Blue 15:1. Subsequently, the resulting mixture was subjected to dispersion treatment employing "CLEARMIX", produced by M TECHNIQUE, whereby a colorant particle dispersion was prepared, resulting in a particle diameter of 93 nm.

<Coagulation Process>

Charged into a four-necked flask fitted with a thermal sensor, a cooling pipe, a nitrogen inletting unit, and a stirrer were 259.3 g (in terms of solids) of Inner Layer Forming Resinous Particles (2-1-1) and 1,120 g of ion-exchanged water and stirred. After bringing the temperature of the mixture to 30° C., the pH was adjusted to 10 by the addition of a 5 mol/liter aqueous sodium hydroxide solution.

Subsequently, while stirring, added was an aqueous solution prepared by dissolving 55.3 g of magnesium chloride hexahydrate in 55.3 ml of ion-exchanged water over a period of 10 minutes. After being allowed to stand for three minutes, the resulting system was heated to 90° C. over a period of 60 minutes, during which Inner Layer Forming Resinous Particles (2-1-2) were coagulated with the colorant particles.

While heating and stirring, the particle diameter of inner layer forming colored particles m1 was determined employing "Coulter Counter TA-II" (produced by Beckmann-Coulter Co.), and when the particle diameter (Dv50) reached 5.5 μm, particle growth was retarded by the addition of an aqueous solution prepared, by dissolving 15.3 g of sodium chloride in 100 ml of ion-exchanged water.

Glass transition point Tgm of inner layer forming colored particles m1 was determined in the same manner as for outer layer forming resinous particles s1. Table 1 shows the measurement results. Incidentally, the molecular weight was determined employing a GPC (gel permeation chromatography) apparatus. The results showed that the molecular weight consisted of two peak molecular weights at 44,000 and 15,000, while the weight average molecular weight was 26,000.

3. Process to Allow Outer Layer Forming Resinous Particles s1 of a High Tg to Firmly Adhere onto Inner Layer Forming Colored Particles m1

(Dispersion of Toner Particles 1)

3-1) Addition Timing of Outer Layer Forming Resinous Particle Dispersion

The pH of 87.5 g (in terms of solids) of outer layer forming resinous particle dispersion (S1) was adjusted to 8 by the addition of a 5 mol/liter aqueous sodium hydroxide solution. The ζ potential of outer layer resinous particle dispersion (S1) was −49.4 mV.

On the other hand, inner layer forming colored particle dispersion (M1) prepared, via a coagulation process, was stirred for approximately one hour while heated. When circularity reached 0.944, one quarter of aforesaid outer layer resinous particle dispersion (S1) was added in four equal portions, whereby outer layer forming resinous particles s1 were allowed to migrate to the surface of inner layer forming colored particles m1, and were allowed to adhere firmly. The circularity after adding outer layer forming resinous particles s1 was 0.956.

Thereafter, added was an aqueous solution prepared by dissolving 123.9 g of sodium chloride in 500 g of ion-exchanged water, and upon further decreasing the coagulation force of particles, stirring was continued at 95° C. for an additional two hours to complete fusion. Further, while stirring, heating was continued until sphericity (circularity) reached the specified value. Thereafter, cooling was performed at a rate of 8° C./minute. The pH was adjusted to 2 by the addition of hydrochloric acid, and stirring was terminated. The resulting dispersion was designated as Toner 1 dispersion.

4. Solid/Liquid Separation, Drying, and External Addition Mixing Processes 4-1) Solid/Liquid Separation and Drying Processes Toner 1 dispersion was treated employing a centrifugal dehydrator and was washed while sprinkling 40° C. ion-exchanged water at 40° C. Thereafter, drying was performed via a 40° C. air flow, whereby Toner Particles 1 were obtained.

4-2) External Addition Mixing Process

Added to above Toner Particles 1 were 0.8 parts by weight of hydrophobic silica and 1.0 part by weight of hydrophobic titanium oxide. The resulting mixture was blended for 25 minutes while setting a peripheral rate of the rotating blade of a Henschel mixer, whereby it was possible to prepare Toner 1 composed of Toner Particles 1.

(Preparation of Toner 2)

Toner 2 was prepared in the same manner as Toner 1, except that outer layer resinous particle dispersion (S1) was replaced with outer layer forming resinous particle dispersion (S2), and the total added amount of the outer layer forming resinous particle dispersion as well as circularity at the beginning and end of the addition was varied as listed in Table 1.

When outer layer forming resinous particles dispersion (S2) was prepared, Polymerizable Monomer Solution 1-1-3 was altered as described below.

| | |
|---|---|
| Styrene | 316.3 g |
| n-Butyl acrylate | 115.9 g |
| Methacrylic acid | 35.5 g |
| n-Octyl-3-mercaptopropionic acid ester | 9.55 g |

(Preparation of Toner 3)

Toner 3 was prepared in the same manner as Toner 1, except that outer layer forming resinous particle dispersion (S1) was replaced with outer layer forming resinous particle dispersion (S3), the divisional addition times were changed from 4 to 3, and the total added amount of the outer layer forming resinous particle dispersion as well as circularity at the beginning and end of the addition was varied as listed in Table 1.

When outer layer forming resinous particle dispersion (S3) was prepared, Polymerizable Monomer solution 1-1-2 was altered as described below.

| | |
|---|---|
| Styrene | 336.3 g |
| n-Butyl acrylate | 90.5 g |
| Methacrylic acid | 35.5 g |
| n-Octyl-3-mercaptopropionic acid ester | 9.55 g |

(Preparation of Toner 4)

Toner 4 was prepared in the same manner as Toner 1, except that being different from the preparation of inner layer forming colored particles (m1), inner layer forming colored particles (m2) was prepared by employing the polymerizable monomer solution composed as described below instead of the dispersion of Polymerizable Monomer solution 2-1-2, divisional addition times were altered to 7, and the total added amount of the outer layer forming resinous particle dispersion as well as the circularity at the beginning and end of the addition was altered as listed in Table 1.

| | |
|---|---|
| Styrene | 261.2 g |
| n-Butyl acrylate | 160.2 g |
| Methacrylic acid | 42.9 g |
| n-Octanethiol | 7.51 g |

Toner 5 was prepared in the same manner as Toner 4, except that outer layer forming resinous particle dispersion (S1) was replaced with outer layer resinous particle dispersion (S5), divisional addition times were altered to 7, and the total added amount of the outer layer forming resinous particle dispersion as well as the circularity at the beginning and end of the addition was altered as listed in Table 1.

When outer layer forming resinous particle dispersion (S5) was prepared, Polymerizable Monomer Solution 1-1-3 was altered as described below.

| | |
|---|---|
| Styrene | 382.3 g |
| n-Butyl acrylate | 61.9 g |
| Methacrylic acid | 35.5 g |
| n-Octyl-3-mercaptopropionic acid ester | 9.55 g |

(Preparation of Toner 6)

Toner 6 was prepared in the same manner as Toner 1, except that outer layer forming resinous particle dispersion (S1) was replaced with outer layer forming resinous particle dispersion (S6), divisional addition times were changed from 4 to 2, and the total added amount of the outer layer forming resinous particle dispersion, as well as the circularity at the beginning and end of the addition was altered as listed in Table 1.

When outer layer forming resinous particle dispersion (s6) was prepared, Exemplified Compound (19) was not added. Further, Polymerizable Monomer Solution 1-1-3 was altered as described below.

| | |
|---|---|
| Styrene | 315.3 g |
| n-Butyl acrylate | 129.9 g |
| Methacrylic acid | 35.5 g |
| n-Octyl-3-mercaptopropionic acid ester | 9.55 g |

(Preparation of Comparative Toner 7)

Comparative Toner 7 was prepared in the same manner as Toner 1, except that outer layer forming resinous particle dispersion (S1) was replaced with outer layer forming resinous particle dispersion (S7), divisional addition times were changed from 4 to 1, and the total added amount of the outer layer resinous particle dispersion as well as the circularity at the beginning and end of the addition was altered as listed in Table 1.

When outer layer forming resinous particle dispersion (S7) was prepared, Exemplified Compound (19) was not added to Polymerizable Monomer Solution 1-1-2. Further, Polymerizable Monomer Solution 1-1-3 was altered as described below.

| | |
|---|---|
| Styrene | 310.3 g |
| n-Butyl acrylate | 134.9 g |
| Methacrylic acid | 35.5 g |
| n-Octyl-3-mercaptopropionic acid ester | 9.55 g |

(Preparation of Comparative Toner 8)

Comparative Toner 8 was prepared in the same manner as Toner 4, except that outer layer forming resinous particle dispersion (S1) was replaced with outer layer forming resinous particle dispersion (S8), 7 divisional addition times were changed to continuous dripping addition over a period of two hours, and the total added amount of the outer layer resinous particle dispersion as well as the circularity at the beginning and end of the addition was altered as listed in Table 1.

When outer layer forming resinous particle dispersion (S8) was prepared, Polymerizable Monomer Solution 1-1-3 was altered as described below.

| | |
|---|---|
| Styrene | 392.3 g |
| n-Butyl acrylate | 51.2 g |
| Methacrylic acid | 35.5 g |
| n-Octyl-3-mercaptopropionic acid ester | 9.55 g |

(Determination of Physical Properties of Toner)

<Determination of Cross-Sectional Area Ratio of Outer Layer to Inner Layer, and 5-Point Average of Non-Uniform Thickness>

Values for each of the above items were determined as described below.

Toner particles are dispersed into resins to result in inclusion. Thereafter, slices are prepared employing a cutter such as an ultra-microtome.

Subsequently, 1) images are captured by a high resolution transmission type electron microscope, 2) viscoelastic images captured by a scanning type probe microscope 3) are transmitted to an image analysis apparatus, whereby a cross-sectional shape is converted to numerical values. In the interface of the inner layer and the outer layer, image 1) and image 2) are overlapped, and if desired, the resulting image is drawn employing image analysis software. Thereafter, determined are the cross-sectional area of the outer layer with respect to the inner layer as well as the non-uniform thickness average at 5 points. Alternatively, without using the image analysis apparatus, an image is transferred onto a sheet and the inner layer and the outer layer are cut out, whereby it is possible to determine the weight or length of cut-out pieces. The above determination is performed for at least 10 toner particles, and the results are represented as an arithmetical mean.

1. Method for Inclusion and Scraping of Toner

Resins used for dispersing toner particles are selected from those which do not swell the toner. After sufficiently dispersing toner particles into epoxy resins, hardenable at normal temperature, hardening is performed at an ambience of 40° C. for two days, and the surface of the resulting hardened product is smoothed employing an ultra-microtome fitted with a diamond knife.

2. Image Capturing 2-1. Observation with the Use of High Resolution Transmission Type Electron Microscope An observation sample is prepared by placing a slice, which is scraped employing an ultra-microtome, on a grid mesh adhered with a micro grid. Thereafter, the structure and composition of the resulting sample are determined employing a 200 kV field emission type TEM, "JEM-2010F", (produced by JEOL Ltd.) and an energy dispersing type X-ray spectrophotometer (EDS), "Voager" (produced by ThermoNORAN). Conditions are set as follows.

| | |
|---|---|
| Accelerating voltage | 200 kV |
| TEM image observation magnification | 50,000-500,000 times |
| EDS measurement time (Live time) | 50 seconds |
| Measurement energy range | 0-2,000 eV |

2-2. Scanning Type Probe Microscope

A scanning type probe microscope SPI3800N environment controlling type unit SPA300HV (produced by Seiko Instrument Co.) is used. Measurement conditions are as follows.

Micro-viscoelastic mode (VE-AFM): frequency 3-5 kHz, amplitude 4-6 nm, a measurement area of about 10 μm×about 10 μm, measurement of an appropriate area including one toner particle.

A sample stage is heated from normal temperature at a rate of 5° C./minute.

Tables 1 and 2 show the measurement results.

TABLE 1

| Toner | Developing Agent | Total Added Amount of Outer Layer Forming Resinous Particle Dispersion | Outer Layer Forming Resinous Particles (s) Tgs (° C.) | Inner Layer Forming Resinous Particles (m) Tgm (° C.) | Tgs − Tgm (° C.) | Outer Layer Forming Resinous Particles (s) Divisional Times | Circularity Beginning of Addition | Circularity End of Addition |
|---|---|---|---|---|---|---|---|---|
| Toner 1 | Developing Agent 1 | 350 g | 51.9 | 47.8 | 4.1 | 4 | 0.944 | 0.956 |
| Toner 2 | Developing Agent 2 | 330 g | 55.4 | 47.8 | 7.6 | 4 | 0.940 | 0.976 |
| Toner 3 | Developing Agent 3 | 310 g | 62.5 | 47.8 | 14.7 | 3 | 0.913 | 0.965 |
| Toner 4 | Developing Agent 4 | 370 g | 62.5 | 33.8 | 28.7 | 7 | 0.923 | 0.955 |
| Toner 5 | Developing Agent 5 | 390 g | 77.2 | 33.8 | 43.4 | 7 | 0.903 | 0.969 |
| Toner 6 | Developing Agent 6 | 270 g | 50 | 47.8 | 2.2 | 2 | 0.954 | 0.972 |
| Toner 7 | Developing Agent 7 | 570 g | 49.6 | 47.8 | 1.8 | 1 | 0.894 | 0.948 |
| Toner 8 | Developing Agent 8 | 30 g | 80 | 33.8 | 46.2 | Continuously 2 hours | 0.936 | 0.981 |

TABLE 2

| Toner | Developing Agent | Cross-sectional Area Ratio | 5-Point Average of Non-uniform Thickness (μm) | Circularity after Completion of Toner | Particle Diameter (μm) |
|---|---|---|---|---|---|
| Toner 1 | Developing Agent 1 | 0.3 | 0.4 | 0.966 | 6.55 |
| Toner 2 | Developing Agent 2 | 0.29 | 0.4 | 0.986 | 6.51 |
| Toner 3 | Developing Agent 3 | 0.27 | 0.3 | 0.975 | 6.47 |
| Toner 4 | Developing Agent 4 | 0.32 | 0.5 | 0.965 | 6.59 |
| Toner 5 | Developing Agent 5 | 0.33 | 0.5 | 0.979 | 6.62 |
| Toner 6 | Developing Agent 6 | 0.24 | 0.3 | 0.982 | 6.38 |
| Toner 7 | Developing Agent 7 | 0.48 | 1.2 | 0.957 | 6.95 |
| Toner 8 | Developing Agent 8 | 0.03 | 0.1 | 0.991 | 5.84 |

(Preparation of Developing Agent)

Developing Agent 1 of a toner concentration of 6 percent by weight was prepared by blending toner particles, including external agents, with a carrier.

(Preparation of Carrier)

(1) Production of Ferrite Core Materials

In a wet process ball mill, 18 mol % MnO, 4 mol % MgO, and 78 mol % of $Fe_2O_3$ were crushed, mixed for two hours, and subsequently dried. Thereafter, the resulting mixture was temporarily burned, and the resulting product was pulverized over a period of three hours employing a ball mill, resulting in a slurry. Dispersing agents and binders were added, subsequently granulated employing a spray drier, and dried. Thereafter, major burning was performed at 1,200° C. for 3 hours, whereby ferrite core material particles of a resistance value of $4.3\times10^8$ Ω·cm were obtained.

(2) Production of Coating Resins

Initially, a cyclohexyl methacrylate/methyl methacrylate copolymer (at a 5/5 copolymerization ratio) was synthesized employing an emulsion polymerization method in which the concentration of sodium benzenesulfonate, containing an alkyl group having 12 carbon atoms, in an aqueous solution was 0.3 percent by weight, whereby resinous particles were obtained, which exhibited a volume average primary particle diameter of 0.1 μm, an weight average molecular weight (Mw) of 200,000, a number average molecular weight (Mn) of 91,000, Mw/Mn of 2.2, a softening temperature (Tsp) of 230° C., and glass transition temperature (Tg) of 110° C. Incidentally, the above resinous particles formed an azeotropic mixture with water in an emulsified state, and the residual monomer was set at 510 ppm.

Subsequently, charged into a high speed stirring and mixing device fitted with stirring blades, utilizing mechanical impact force, were 100 parts by weight of ferrite core materials particles and 2 parts by weight of the aforesaid resinous particles, and blended at 120° for 30 minutes, whereby a resinous covering carrier of particle diameter (Dv50) of 61 μm was obtained.

(Evaluation of Practical Imaging)

Developing Agent 1 was evaluated for each of the evaluation items described below, employing, as an evaluation apparatus, a digital copier Konica "Sitios 8050" (using, as processes, corona charging, laser exposure, reversal development, electrostatic transfer, and blade cleaning at a printing rate of 50 sheets/minute), produced by Konica Corp. Incidentally, the fixing unit utilized an eddy current heating system (in which the heating member is subjected to electromagnetic induction heat generation).

Fixing roller 1 was structured in such a manner that a releasing layer 8 of a thickness 20 μm of PFA, fluororesin was formed on the surface of diameter 50 mm iron cored cylinder 1' of a thickness of 0.7 mm. The resulting nip width was 7.1 mm, while the peripheral rate of the roller was set at 330 mm/second.

<Storage Stability and Fixability of Toner>

After allowing toner to stand at an ambience of 55° C. and 85% relative humidity, the weight of toner particles which passed through a 28-mesh sieve was determined and evaluation was performed based on its weight ratio.

A: the mesh passing ratio was at least 90% (excellent storage stability), and no insufficient fixing occurred during the fixing test at low temperature and low humidity (10° C. and 20% relative humidity)

B: the mesh passing ratio was 60 to less than 90% (good storage stability), and no insufficient fixing occurred during the fixing test at low temperature and low humidity (10° C. and 20% relative humidity)

C: the mesh passing ratio was less than 60% (poor storage stability) and image staining due to insufficient fixing was noted during the fixing test at low temperature and low humidity (10° C. and 20% relative humidity)

<Resolution>

Fluctuation of resolution among lots was evaluated in such a manner that images were printed at a latent image writing density of 600 dpi (dpi refers to the number of dots per inch or 2.54 cm) mode, and the resulting resolution was evaluated. A black-and-white pattern of eight lines per mm was printed in the primary scanning direction, and the peak value of a sample frequency analysis with respect to the standard peak value of the frequency analysis of one line per mm in image density was obtained and evaluated based on the criteria below.

A: the ratio with respect to the standard peak value was at least 75%

B: the ratio with respect to the standard peak value was 50-75%, being good

C: the ratio with respect to the standard peak value was 30-50%, being commercially viable D: at least one batch exhibited the ratio with respect to the standard peak value of less than 50% and at least 8 batches which exhibited the ratio of 40-50%

<Non-Uniform Glossiness>

A solid image was printed on both sides and the portion in which the image was cooled via contact with the paper discharging roller was compared to the portion except for the above.

A: glossiness was uniform

B: slight streaking existed, but was noticeable, only when carefully observed

C: non-uniform glossiness was readily noticed

<Quality Evaluation of Z-Fold Portion after Fixing>

After printing of text original at a pixel ratio of 12% on 50 A4 sheets, Z-folding was performed employing an automated Z-folding apparatus so that A3 size printed matter looked as A4 size, followed by binding, whereby image quality was evaluated.

A: no adhesion was noted in the Z-fold portions and no toner peeled off when the folded portion was rubbed B: no adhesion was noted in the Z-fold portions and toner peeled slightly when the folded portion was rubbed, however, resulting however in no problem for commercial viability C: the Z-fold portions was subjected to adhesion, and toner in the folded position peeled, whereby the transfer paper was partially exposed <Evaluation of Paper Alignment Properties>

At the same temperature conditions as above, 5 copies, seta of 100 sheets were discharged and each set of 100 sheets was subjected to bookbinding employing an attached bookbinding apparatus. Regarding the bookbinding apparatus, evaluation was performed based on the criteria below.

A: edges of all pages were aligned in a range of less than 0.2 mm, resulting in acceptable bookbinding B: edges of all pages were aligned in a range of 0.2-0.5 mm, resulting in acceptable bookbinding C: edges of some pages were deviated more than 0.5 mm, resulting in no aligned bookbinding Table 3 shows the results.

As can be seen from Table 3, Toners 1-6 were superior to Toners 7 and 8 in terms of some or all of storage stability, fixability, resolution, non-uniform glossiness, quality of Z-fold portions after fixing, and further paper edge alignment properties.

Namely, it became possible to achieve fixing at low temperatures, the toner exhibited excellent storage stability, and it was possible to produce high quality images of minimal non-uniform glossiness as well as high resolution. Further it was found that even though, immediately after fixing, bookbinding or saddle stitch bookbinding is performed, or Z-fold sheets are bound, no adhesion between toners occurs and appearance after bookbinding is excellent due to desired paper alignment properties, and in addition, in belt fixing or IH fixing, it was possible to use the toner by only lowering the specified fixing temperature, resulting in no formation of off-setting and insufficient fixing.

Namely, as shown in Table 3, a toner capable of exhibiting at list one of the various types of performance such as fixability at low temperatures, excellent storage stability, minimized uneven glossiness, and production of high quality images of excellent resolution was obtained.

The toner capable of exhibiting at least one of the types of performance such as minimized adhesion between toner images, excellent regular stacking, or excellent appearance after bookbinding even when bookbinding, saddle stitch bookbinding, and z-fold paper binding are conducted immediately after fixing was obtained.

What is claimed is:

1. A production method of a toner comprising toner particles, each of which comprises an inner layer and an outer layer covering the inner layer, the method comprising the steps of:

preparing a dispersion of core particles as the inner layer and, forming the outer layer by dividing an outer layer forming resinous particle dispersion into 2 to 8 portions and adding each of the portions discontinuously into the dispersion of core particles as the inner layer, wherein the toner satisfies a), b), c), d), and e):

a) a cross-sectional area ratio of the outer layer to the inner layer ranges from 0.05 to 0.46, b) the thickness of the outer layer is non-uniform,

TABLE 3

| Toner | Developing Agent | Storage stability and Fixability of Toner | Resolution | Non-uniform Glossiness | Quality of Z-Fold Portions after Fixing | Paper Aligning Properties |
|---|---|---|---|---|---|---|
| Toner 1 | Developing Agent 1 | A | A | A | A | A |
| Toner 2 | Developing Agent 2 | A | A | A | A | A |
| Toner 3 | Developing Agent 3 | A | A | A | A | A |
| Toner 4 | Developing Agent 4 | B | A | B | B | B |
| Toner 5 | Developing Agent 5 | B | A | B | B | B |
| Toner 6 | Developing Agent 6 | B | B | B | B | B |
| Toner 7 | Developing Agent 7 | C | C | C | C | C |
| Toner 8 | Developing Agent 8 | C | B | C | C | C |

c) the average thickness (t) taken at 5 positions of the outer layer ranges from 0.2 to 1.0 μm, and is calculated according to the formula $t=(t_1+t_2+t_3+t_4+t_5)/5$ (unit of $t_1$-$t_5$ is μm) wherein $t_1$ represents a thickness of the thickest part of the outer layer, and $t_2$-$t_5$ represent a thickness of a second to a fifth thickest part of the outer layer in one particle, respectively, d) a glass transition point Tg of the inner layer ranges from 2 to 45° C. lower than a glass transition point Tg of the outer layer, e) the toner exhibits an average value of circularity ranging from 0.954 to 0.992, which is calculated by averaging the circularity of at least 2000 toner particles having a particle diameter of at least 1 μm, wherein the circularity of a toner particle=(peripheral length of equivalent circle)/(peripheral length of projected image of toner particle)=$2\pi\times$(projected area of particlerr)$^{1/2}$/(peripheral length of projected image of toner particle).

2. The production method of claim 1, wherein the inner layer comprises a first resin, a colorant and at least one releasing agent, and the outer layer comprises a second resin.

3. The production method of claim 1, wherein a variation coefficient of a volume based particle size distribution of the toner ranges from 10.1 to 22.6 percent.

4. The production method of claim 1, wherein a variation coefficient of a volume based particle size distribution of the toner particle is no greater than 27 percent.

5. The production method of claim 1, wherein the core particles have a particle diameter ranging from 2.5 to 9.0 μm.

6. The production method of claim 3, wherein the variation coefficient of a volume based particle size distribution of the core particles ranges from 14 to 20 percent.

7. The production method of claim 5, further comprising obtaining second resin particles comprising a second resin and having a volume based particle diameter ranging from 51 to 240 nm to firmly adhere on the colored particles.

8. The production method of claim 2, wherein the at least one releasing agent is chosen from polypropylene, polyethylene, and an ester based compound represented by the Formula $R_1$—(OCO—$R_2$)$_n$, wherein n represents an integer between 1-4, and $R_1$ and $R_2$ each represent a hydrocarbon group that may have a substituent.

9. The production method of claim 1, exhibiting a number averaged particle diameter of 3-10 μm.

10. The production method of claim 1, wherein a volume variation coefficient of the toner particles is at most 27 percent.

11. The production method of claim 1, wherein the toner exhibits an average value of circularity ranging from 0.955 to 0.976.

12. The production method of claim 2, wherein the at least one releasing agent is chosen from an ester based compound represented by the Formula $R_1$—(OCO—$R_2$)$_n$, wherein n represents an integer between 1-4, and $R_1$ and $R_2$ each represent a hydrocarbon group that may have a substituent.

13. The production method of claim 12, wherein the inner layer and the outer layer include the at least one releasing agent.

14. The production method of claim 2, wherein the outer layer is formed on the inner layer by adhering second resinous particles on the core particles in a core particle dispersed solution, and wherein the core particles have a particle diameter of 3.5-7.0 μm, the variation coefficient in the volume based particle size distribution of the core particles is in the range of 15.5-18.5%.

15. The production method of claim 1, wherein the outer layer is formed by dividing an outer layer forming resinous particle dispersion into 2 to 8 portions, and adding each of the portions discontinuously into an inner layer forming colored particle dispersion, and wherein the particle diameter of resinous particles in said outer layer forming resinous particle dispersion ranges from 51 to 240 nm.

16. The production of claim 2, wherein the toner satisfies, the inner layer comprises a core particle having an average value of circularity ranging from 0.903 to 0.954, which is calculated by averaging the circularity of at least 2000 core particles having a particle diameter of at least 1 μm, wherein the circularity of a core particle=(peripheral length of equivalent circle)/(peripheral length of projected image of core particle)=(peripheral length of equivalent circle)/(peripheral length of projected image of core particle)=$2\pi\times$(projected area of particle/$\pi$)$^{1/2}$/(peripheral length of projected image of core particle).

17. The production method of claim 2, wherein the outer layer is formed by dividing an outer layer forming resinous particle dispersion into 3 to 5 portions.

* * * * *